US005277765A

United States Patent [19]

Graf et al.

[11] Patent Number: 5,277,765

[45] Date of Patent: Jan. 11, 1994

[54] HEADBOX WITH A VERTICAL PARTITION BETWEEN PERFORATED ROLLS

[75] Inventors: Edwin X. Graf, Menasha; James L. Strebig, Appleton, both of Wis.

[73] Assignee: Voith, Inc., Appleton, Wis.

[21] Appl. No.: 900,952

[22] Filed: Jun. 18, 1992

[51] Int. Cl.[5] ..... D21F 1/02

[52] U.S. Cl. ..... 162/342; 162/216

[58] Field of Search ..... 162/216, 336, 342, 344

[56] References Cited

U.S. PATENT DOCUMENTS 2,881,674 4/1959 Johnson et al. ..... 162/342

3,164,513 1/1965 Calehuff ..... 162/212

*Primary Examiner*—Karen M. Hastings

*Attorney, Agent, or Firm*—Baker & Daniels

[57] ABSTRACT

A headbox for a paper machine, with a main chamber through the lower part of which flows fiber suspension in the longitudinal machine direction. The main chamber has on the upstream end a first perforated roll and a machine-wide feed channel as well as on the downstream end a second perforated roll and a machine-wide nozzle type outlet channel. Provided between the perforated rolls is a vertical partition which is vertically adjustable, creating between the bottom of the main chamber and the partition a machine-wide channel section which is variable in its height. The downstream outside surface of the partition has a convex shape, in a fashion such that the clearance of the channel section increases in the direction of flow.

13 Claims, 3 Drawing Sheets

HEADBOX WITH A VERTICAL PARTITION BETWEEN PERFORATED ROLLS

BACKGROUND OF THE INVENTION

1. Field of the Invention

The present invention relates to a headbox for a machine for the production of a fiber material web from a fiber suspension, for example in the manufacture of paper and cardboard and, more particularly, to a headbox for such a machine having a vertically adjustable partition.

2. Description of the Related Art

A paper making machine, as is known, has a specific machine width corresponding to the desired width of the fiber material to be produced. The fiber material web is continuously formed from the fiber suspension in that a machine-wide fiber suspension flow is applied on a machine-wide, continuous and revolving wire belt. A headbox serves to form a fiber suspension flow which is generally uniform across the machine width so that the finished fiber material web will possess generally uniform properties across its width. The headbox has in customary fashion a machine-wide main chamber which is defined by an essentially horizontal bottom and two side walls. The side walls extend parallel to the longitudinal direction of the machine with the spacing between the sidewalls approximately the same as the machine width, i.e., the desired web width. The fiber suspension flows in the longitudinal machine direction first through a machine wide feed channel, then through the main chamber and finally a machine wide outlet channel adjacent the main chamber, the height of which tapers in nozzle fashion up to a machine-wide outlet gap. The headbox must be designed such that the machine-wide fiber suspension flow leaving it has a flow velocity which is generally uniform across the machine width, and so that the fiber material is uniformly distributed in the fiber suspension. To provide optimal uniform distribution of the fiber material, fiber suspension flow should be such that a so-called microturbulence is present which, in turn, should be distributed uniformly across the machine width. The microturbulence prevents the fibers from balling up into flakes, from which a non-uniform fiber distribution would result in the finished fiber material web. The microturbulence is caused by the fiber suspension flowing in known fashion into the feed channel through a bundle of turbulence tubes.

At the transition point from the feed channel to the main chamber there is a rotatable perforated roll provided which in known fashion extends transverse to the longitudinal machine direction through the main chamber and is rotatably mounted in the sidewalls. A second perforated roll of the same type is provided at the transition point from the main chamber to the outlet channel. A similar arrangement of perforated rolls is disclosed in U.S. Pat. No. 2,881,674. The level of the fiber suspension flow passing through the main chamber is always lower than the clearance of the main chamber, i.e., an air cushion is contained in the main chamber above the suspension level. The pressure of the air cushion can be varied in known fashion, in accordance with the desired flow velocity at the outlet gap.

Also known is arranging in the center area of the main chamber, between the two perforated rolls, a partition which extends generally vertically and cross-wise to the longitudinal machine direction. The partition is vertically adjustable, so that between the bottom of the headbox and the bottom edge of the partition there exists a machine-wide channel section which is variable in height. This channel section forms a partial local obstruction to the fiber suspension flow between the two perforated rolls, which obstruction serves as well to maintain the microturbulence. The height of the channel section is adjusted to obtain a desired flow rate.

A headbox of known construction is illustrated in FIG. 1A and includes a downstream outside surface of the partition which extends in a generally vertical direction from the downstream bottom edge of the partition. Moreover, in a region slightly downstream from the bottom edge there is a slat arranged on the bottom. The distance between the adjustable height bottom edge of the partition and the slat determines the flow cross section for the fiber suspension flow. With this prior design, it was occasionally observed that when the flow rate is relatively low and, therefore, the clearance of the channel section is made relatively small as well, there occur downstream from the partition relatively large eddies which are not uniformly distributed across the machine width. The second perforated roll on the downstream side of the partition is apparently unable to sufficiently dissolve these eddies so that, as a result, the finished fiber material web has a non-uniform basis weight across the web width. This formation causes relatively large flakes or "clouds" to be recognized in the finished paper, indicating that the fiber material is not sufficiently and uniformly distributed in the web.

In said headbox of known construction, the lower part of the partition is tapered in such a way that the clearance of the channel section (defined by the bottom and by the partition) becomes smaller in the direction of flow. In this prior design, therefore, the end of the channel section has the form of a slot-type discharge gap. Such a slot-type discharge gap causes the above-described problem of non-uniform distribution of the fiber material in the fiber suspension.

What is needed in the art is a headbox which produces minimal eddies in the fiber suspension flow, and a flow velocity and microturbulent state of flow which are generally uniform across the machine width.

SUMMARY OF THE INVENTION

The present invention provides a headbox having a downstream outside surface of the partition (at least in the lower areas thereof) which is so inclined relative to the vertical direction (i.e., to an imaginary vertical plane) that the clearance of a channel section defined by the downstream outside surface of the partition increases with the flow direction.

The invention comprises, in one form thereof, a headbox for a machine used in production of a fiber material web from a fiber suspension. A main chamber is defined by a bottom and two side walls which extend parallel to the longitudinal machine direction such that the fiber suspension can flow through the main chamber in the longitudinal direction of the machine. A first perforated roll and a machine-wide feed channel are disposed in and at the upstream end of the main chamber. A second perforated roll and a machine wide nozzle type outlet channel are disposed in and at the downstream end of the main chamber. A partition is disposed in the main chamber between the first and second perforated rolls. The partition extends generally vertically and transverse to the longitudinal machine direction, is vertically adjustable, and defines a machine-wide channel section having a variable height. The partition has a downstream outside surface which is inclined from top to bottom relative to the vertical such that the variable height of the channel section increases in the direction of flow.

An advantage of the present invention is that a fiber material web with a uniform basis weight cross profile can be produced.

Another advantage is that a fiber material web with a uniform basis weight cross profile can be produced at relatively low flow velocities.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
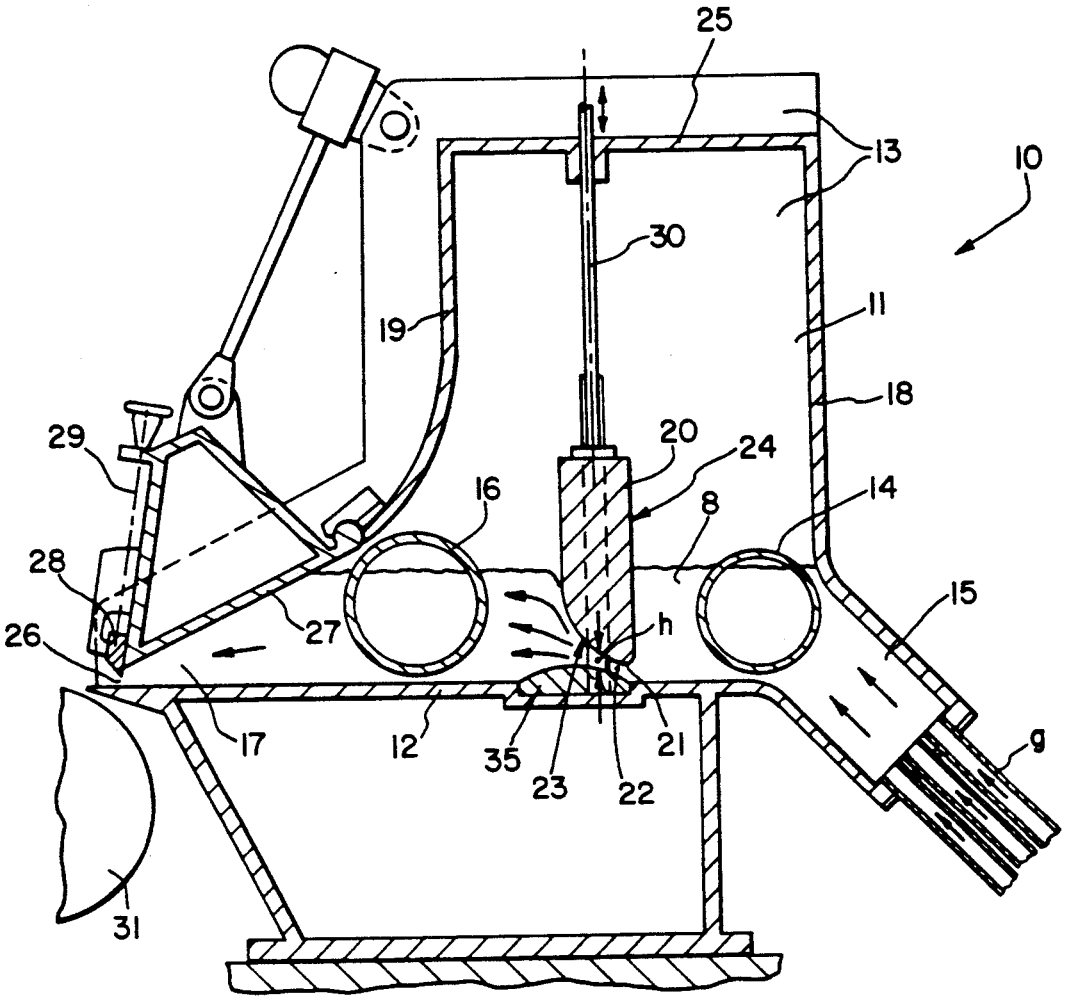
FIG. 1 is a side sectional view of the present invention.

Referring now to the drawings, and particularly to FIG. 1, a machine for producing a fiber material web from a fiber suspension generally includes a headbox 10 and breast roll 31.

Breast roll 31, which is partially shown in FIG. 1, rotatably carries a continuous wire belt (not shown) of the paper machine on which a fiber material web is formed in known fashion from the fiber suspension discharged from the headbox 10.

Headbox 10 includes a bundle of turbulence tubes 9, a feed channel 15, a main chamber 11 and a nozzle type outlet channel 17. Main chamber 11 is defined by a preferably horizontal bottom 12 and by two vertical side walls 13. Side walls 13 extend parallel to the longitudinal machine direction and allow the fiber suspension 8 to flow through the bottom area of the main chamber 11 in the longitudinal machine direction. Provided at the transition point from the feed channel 15 to the main chamber 11 is a first rotatable perforated roll 14 which is rotatably mounted in the side walls 13. An identical second perforated roll 16 is provided at the transition point from the main chamber 11 to the outlet channel 17. Further components defining the main chamber 11 are a rear wall 18, a front wall 19 and a cover 25.

As shown in FIG. 1, the height of the main chamber 11 is considerably greater than the (variable) level of the fiber suspension 8 flowing through the main chamber 11. Contained above the level of the fiber suspension level in the main chamber is thus an air cushion. The pressure of this air cushion can be varied in known fashion in accordance with the desired flow velocity at the discharge gap 26, which is located at the end of the nozzle type outlet channel 17. The clearance of the discharge gap 26 can be varied in known fashion by means of a movable channel wall 27 and, additionally, by means of a slat 28. The slat 28 (also called a "slice blade") can be slightly deformed locally for purposes of a local correction of the clearance of the discharge gap 26, in known fashion by means of a number of spindles 29 which are arranged in a distributed manner across the machine width.

A partitioning wall 20 is provided in the center area of the main chamber 11, between the two perforated rolls 14 and 16. Partition 20 extends in a generally vertical direction and is adjustable in a vertical direction. Moreover, partition 20 extends in a transverse direction across the entire machine width and the entire main chamber 11 (i.e., perpendicular to the drawing plane). Contained between the bottom 12 and the bottom edge 21 of the partition 20 is a machine-wide channel section 22 through which the entire fiber suspension must flow. The clearance h of the channel section 22 is variable in that the partition 20 is movable in a vertical direction, e.g., using actuator spindles 30.

Partitioning wall 20 has a downstream outside surface 23 forming channel section 22 which is shaped such that the clearance h of the section 22, starting from the bottom edge 21, increases in the direction of flow. The upstream outside surface 24 of the partition 20, contrarily, in the illustrated embodiment, extends in a generally vertical direction; however, a variation thereof is permitted if desirable. For example, it may be favorable to round the bottom edge 21 of the partition 20 at the inlet to the channel section 22.

The downstream outside surface 23 is vertically arranged only in its upper area which does not define channel section 22. The lower part of the downstream outside surface 23 is inclined relative to the vertical direction, e.g., relative to the upstream outside surface 24. The lower part of the outside surface 23 may have a convex rounding according to FIG. 1; but is preferably shaped polygonally, according to FIG. 2. In an alternative embodiment (FIG. 3), the lower part of outside surface 23 may be generally flat and rounded in convex fashion at the downstream side thereof. Common to all of these embodiments is that, as mentioned above, the clearance h of the channel section 22 contained between the bottom 12 and the partition 20 (or 20', FIG. 3) increases in the direction of flow. It is important that this increase in height is progressive. That is, the clearance h (per centimeter of flow distance) should increase initially only slightly and thereafter ever more distinctly.

If the downstream outside surface 23 is formed having a polygon shape (FIG. 2), the outside surface 23 is composed of several butted flat surface sections which pairwise form an obtuse angle w with one another. This angle w is at least 166°, and is preferably about 170° to 173°. In the embodiment shown in FIG. 2, the downstream outside surface includes a vertical downstream surface (not numbered) and at least three other abutted flat surfaces, including bottom edge 21 and abutted flat surfaces 23 extending between bottom edge 21 and the vertical downstream surface. The abutted flat surfaces, including surfaces 21, 23 and the vertical downstream surface, define a polygonal shape, with adjacent flat surfaces defining an obtuse angle therebetween.

Figure 2:
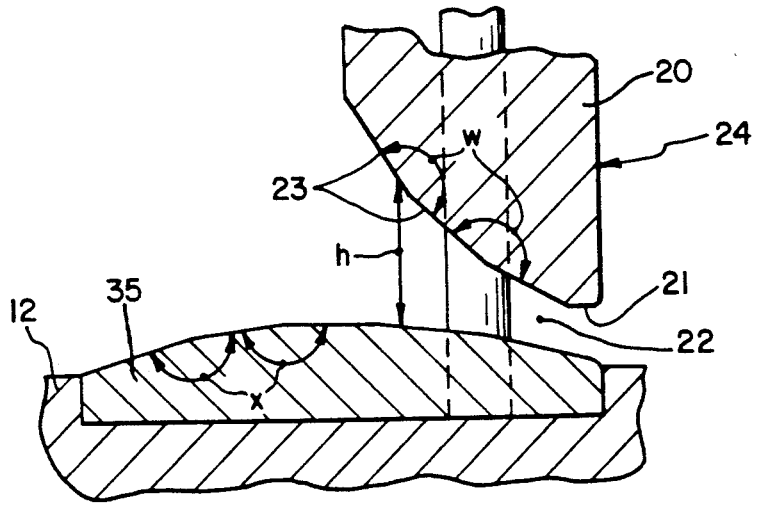
FIG. 2 is an enlarged sectional view of the partition, bottom and threshold shown in FIG. 1.
Figure 1A:
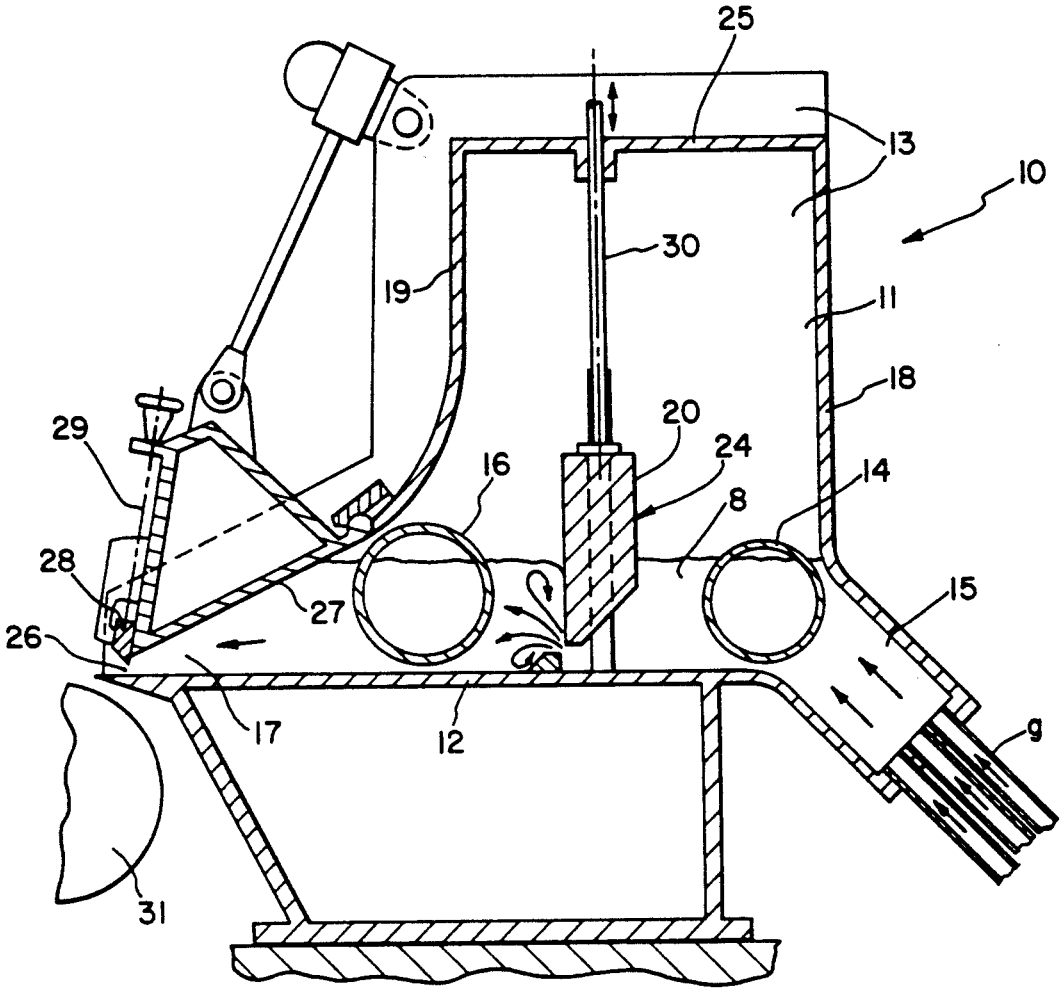
PRIOR ART FIG. 1A
FIG. 1A is a side sectional view of a headbox of known construction.

Alternatively, FIG. 2 may be described as having a downstream outside surface including at least four abutted flat surfaces defining a polygonal shape, with adjacent abutted flat surfaces defining an obtuse angle therebetween.

The positive effect of the inventional design of the partition as described above can be increased by forming a threshold 35 arranged in the bottom 12 of the main chamber 11. Threshold 35, similar to the downstream outside surface 23 of the partition 20, is formed with a convex shape similar to a polygon; i.e., several flat partial surfaces are again butted together forming pairwise an obtuse angle x of at least 166° preferably between 170° to 173°, and more preferably about 173°.

Figure 3:
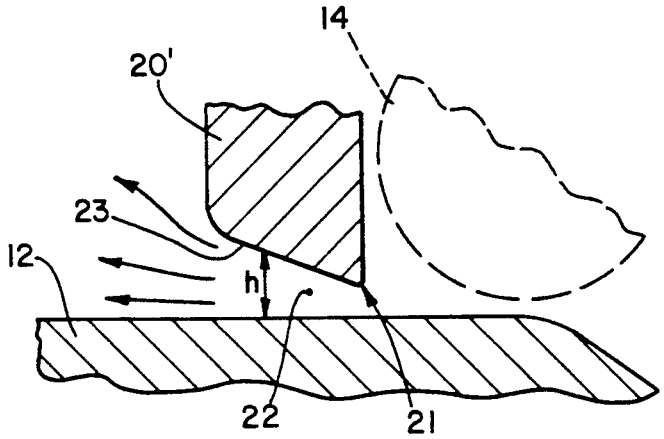
FIGS. 3 and 4 illustrate alternative embodiments of the present invention.

According to FIGS. 1 and 2, the threshold 35 is formed in that the bottom 12 has a recess in which a threshold element is fitted. It is also possible to mold the threshold 35 directly on the bottom 12. Moreover, threshold 35 may be omitted (FIG. 3). This may be desirable, for instance, if the first perforated roll 14, or both perforated rolls 14 and 16, have a relatively large diameter and/or if relatively large flow rates are always to be expected.

A downstream outside surface 23 of partition 20 which is shaped in the fashion of a polygon has the advantage, as compared to a shape rounded in convex fashion, of causing separation of the flow from the outside surface 23, if such separation occurs, to be located at the polygon corners of outside surface 23, thereby uniformly distributing the separation across the machine width. Such a design thus supports the maintenance of a microturbulence which is uniform across the machine width. The same applies to the polygonal outside surface of the threshold 35, if a threshold 35 is used in accordance with FIGS. 1 and 2.

In the embodiment shown in FIG. 1, partition 20 is arranged approximately centered between perforated rolls 14 and 16. However, in an alternative embodiment (FIGS. 3 and 4), the distance from the partition 20' and 20'', to the first perforated roll 14, 14', may also be smaller than the distance from the partition to the second perforated roll 16.

Figure 4:
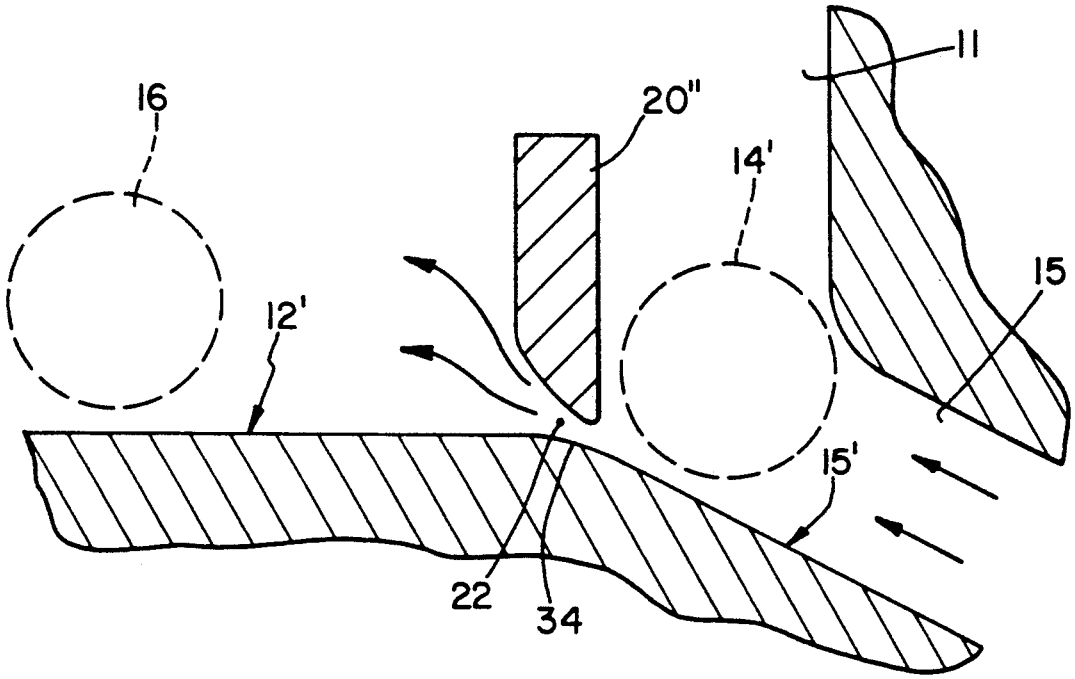

Referring now to FIG. 4, partition 20'' may be disposed directly above a transition point 34 where the bottom 15' of the feed channel 15 extends into the bottom 12' of the main chamber 11. As is apparent, transition point 34 is rounded in a manner similar to the threshold 35 shown in FIG. 1. Thus, partition 20 and threshold 35 (FIG. 1), and partition 20'' and bottoms 12' and 15' forming transition point 34 (FIG. 4), both form a channel section 22 with a clearance h which progressively increases in flow direction.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A headbox for a machine used in production of a fiber material web from a fiber suspension, said headbox comprising:

a main chamber defined by a bottom and two side walls which extend parallel to the longitudinal machine direction such that the fiber suspension can flow through said main chamber in the longitudinal direction of the machine;

a first perforated roll and a machine-wide feed channel disposed in and at an upstream end of said main chamber, and a second perforated roll and a machine wide nozzle type outlet channel disposed in and at a downstream end of said main chamber;

a partition disposed in said main chamber between said first and second perforated rolls, said partition extending generally vertically and transverse to the longitudinal machine direction, said partition being vertically adjustable and defining a machine-wide channel section having a variable height;

said partition having a downstream outside surface which is inclined from top to bottom relative to the vertical such that said variable height of said channel section increases in the direction of flow, said downstream outside surface comprising a generally vertical downstream surface and at least three other abutted flat surfaces, said at least three other abutted flat surfaces defining a polygonal shape and defining an obtuse angle between adjacent said abutted surfaces, said polygonal shape structured and arranged to provide uniform separation of said suspension flow from said downstream outside surface and maintenance of uniform microturbulence within said suspension flow across the machine width.

2. The headbox according to claim 1 wherein said obtuse angle is at least 166°.

3. The headbox according to claim 1 wherein said obtuse angle is 170° to 173 °.

4. The headbox according to claim 1 wherein said channel section is further defined by a threshold of convex shape disposed in the bottom of the main chamber.

5. The headbox according to claim 1 wherein said channel section is further defined by a threshold with a polygonal shape disposed in the bottom of the main chamber.

6. The headbox according to claim 5 wherein said polygonal surface of said threshold is formed by abutted flat surfaces with adjacent surfaces defining an obtuse angle therebetween.

7. The headbox according to claim 6 wherein said threshold obtuse angle is at least 170°.

8. The headbox according to claim 3 wherein said channel section is further defined by a threshold having a polygonal shape formed by butted surfaces with adjacent surfaces forming an obtuse angle therebetween of 170° to 173°.

9. The headbox according to claim 1 wherein said partition is disposed approximately centered between the perforated rolls.

10. The headbox according to claim 1 wherein a distance from the partition to the first perforated roll is smaller than a distance from the partition to the second perforated roll.

11. The headbox according to claim 1 further comprising a feed channel for supplying the fiber suspension to said main chamber, said main chamber and feed channel each having a bottom disposed at an obtuse angle therebetween, and a rounded transition interposed between said main chamber and feed channel bottoms.

12. The headbox according to claim 1 wherein said partition further includes an upstream outside surface which extends in a generally vertical direction.

13. A headbox for a machine used in production of a fiber material web from a fiber suspension, said headbox comprising:

a main chamber defined by a bottom and two side walls which extend parallel to the longitudinal machine direction such that the fiber suspension can flow through said main chamber in the longitudinal direction of the machine;

a first perforated roll and a machine-wide feed channel disposed in and at an upstream end of said main chamber, and a second perforated roll and a machine wide nozzle type outlet channel disposed in and at a downstream end of said main chamber;

a partition disposed in said main chamber between said first and second perforated rolls, said partition extending generally vertically and transverse to the longitudinal machine direction, said partition being vertically adjustable and defining a machine-wide channel section having a variable height;

said partition having a downstream outside surface which is inclined from top to bottom relative to the vertical such that said variable height of said channel section increases in the direction of flow, said downstream outside surface comprising at least four abutted flat surfaces defining a polygonal shape, adjacent said abutted flat surfaces defining an obtuse angle therebetween, said polygonal shape structured and arranged to provide uniform separation of said suspension flow from said downstream outside surface and maintenance of uniform microturbulence within said suspension flow across the machine width.

* * * * *